US006467115B2

(12) United States Patent
Baird

(10) Patent No.: US 6,467,115 B2
(45) Date of Patent: Oct. 22, 2002

(54) SHAPE RETAINER AND METHOD FOR STABILIZING A BOOT SHAFT

(75) Inventor: Diana Baird, County of St. Louis, MO (US)

(73) Assignee: Brown Shoe Company, Inc., St. Louis, MO (US)

( * ) Notice: Subject to any disclaimer, the term of this patent is extended or adjusted under 35 U.S.C. 154(b) by 0 days.

(21) Appl. No.: 09/790,355

(22) Filed: Feb. 21, 2001

(65) Prior Publication Data

US 2002/0112298 A1 Aug. 22, 2002

(51) Int. Cl.[7] ..... A43D 3/00; A43D 5/00; A43D 15/00; A43D 19/00; A43D 95/00

(52) U.S. Cl. ..... 12/128 R; 12/114.2; 12/115.6

(58) Field of Search ..... 12/114.2, 114.4, 12/114.6, 114.8, 115.2, 115.4, 115.6, 115.8, 116.2, 116.4, 116.5, 116.6, 117.2, 117.4, 119.5, 128 R, 133 R, 146 R

(56) References Cited

U.S. PATENT DOCUMENTS 823,853 A * 6/1906 Von Essen ..... 36/114.6
3,041,643 A * 7/1962 Struble ..... 36/128 R
3,483,580 A * 12/1969 Cherry et al. ..... 12/114.4
3,681,804 A * 8/1972 Caputo ..... 12/114.6
3,720,970 A * 3/1973 Lutz ..... 12/114.6
4,497,080 A * 2/1985 Inspector ..... 36/128 R

* cited by examiner

*Primary Examiner*—Anthony D. Stashick
(74) *Attorney, Agent, or Firm*—Polster, Lieder, Woodruff & Lucchesi, L.

(57) ABSTRACT

A sheet of flexible and resilient polymer material is rolled into a tubular configuration and inserted into the shaft of a boot deeply enough to reach the vamp and quarters from which the shaft uses. The rolled sheet, when released, expands under the bias of its own resiliency and bears against the inside of the shaft, thus stabilizing the shaft in an upright position above the quarters and vamp. The upper end of the rolled sheet projects above the upper margin on the shaft, and here the sheet may bear a trademark or other indicia.

18 Claims, 2 Drawing Sheets

SHAPE RETAINER AND METHOD FOR STABILIZING A BOOT SHAFT

BACKGROUND OF THE INVENTION

This invention relates in general to footwear and more particularly to shape retainer and method for stabilizing the shaft of a boot.

The footwear industry offers a variety of stylish boots which women find particularly appealing during the winter months and in inclement weather. The typical boot has a vamp and quarters that are attached to a sole which leads back to an elevated heel. The vamp surrounds the wearer's foot and merges into a shaft which extends upwardly past the wearer's ankle along the wearer's calf. Usually the shaft has a zipper which extends from its upper margin downwardly to the sole to enable the wearer to insert her foot through the shaft and into the vamp.

The vamp, while being flexible, is small enough and has enough rigidity to maintain its shape when the boot is not worn. The same holds true with regard to the quarters. But the shaft does not. It usually folds over immediately above the quarters. This makes boots difficult to display in shoe stores and shoe departments of department stores. Moreover, it leaves the boots with creases which in time may develop into cracks in the leather. Apart from that, a fold in the shaft of a boot restricts the circulation of air through the interior of the vamp, and thus inhibits evaporation of moisture from within the vamp.

To be sure, foam stuffers exist for insertion into the shafts of boots, but they are difficult to install and often do not provide enough rigidity to maintain the shaft upright. Mechanical boot shapers with sides that are urged apart by springs also exist, but they are even more difficult to insert, and furthermore do not reach down into the quarters where the greatest support is required. Then there are cardboard expanders which are bent into a somewhat bowed configuration and fitted into the shafts to hold the shafts open in shoe boxes, but they are not suitable for displays.

SUMMARY OF THE INVENTION

The present invention resides in a boot having a shaft which extends upwardly from the vamp and quarters of the boot and is stabilized in an upright position with a sheet of flexible and resilient polymer material that is in at least a bowed condition and expanded against the inside surface of the shaft. The invention also resides in the method of stabilizing a boot shaft with a bowed sheet of resilient polymer material.

DESCRIPTION OF THE DRAWINGS

Corresponding reference characters indicate corresponding parts throughout the several views of the drawings.

DETAILED DESCRIPTION OF INVENTION

Figure 1:
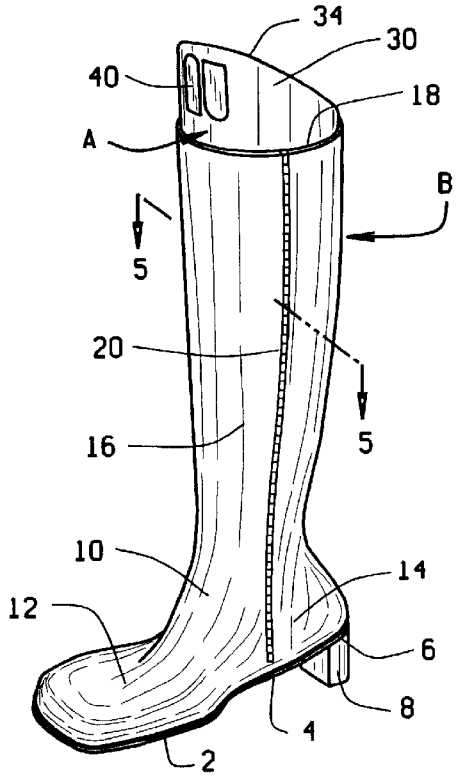
FIG. 1 is a perspective view of a boot having the shape retainer, constructed in accordance with and embodying the present invention, in the shaft of the boot to stabilized the shaft.

Referring now to the drawings, a shape retainer A (FIG. 1) fits into a boot B where it serves to maintain the boot B generally in the shape it would have if worn. As such, the shape retainer A enables a new boot B to be displayed attractively in retail shoe stores and departments. It further enables a boot B, when not worn by the purchaser, to be stored neatly in a condition that fosters the circulation of air through the interior of the boot B. The shape retainer A also minimizes the development of creases which, apart from being unsightly, may develop into cracks in the leather. The shape-retainer fits boots B of a variety of sizes and styles.

The boot B has (FIGS. 1 & 4) a sole 2 including a shank 4 and a heel seat 6 to which an elevated heel 8 is attached. In addition, the boot B has an upper 10 which is formed usually from leather or some other flexible material, perhaps of a synthetic composition. In any event, the upper 10 includes vamp 12 which is attached at the foreportion of the sole 2 and is configured to extend over the user's foot ahead of the ankle. In addition, the upper 10 has two quarters 14 into which the vamp 12 merges and they lie along the sides and back of the user's foot generally above the user's heel and below the user's ankle. Finally, the upper 10 includes a shaft 16 into which the vamp 12 and two quarters 14 merge. Indeed, the shaft 16 extends upwardly from the vamp 12 and quarters 14 at the region of the user's ankle and completely covers the user's ankle as well as at least the lower portion of the user's calf. The shaft 16 terminates at an upper margin 18 and contains a zipper 20 which extends downwardly from the upper margin 18 through the quarter 14 at the inside of the user's foot and terminates near the shank 4 of the sole 2.

While the vamp 12 and quarters 14 will flex, particularly in the regions above the shank 4 of the sole 2, the vamp 12 in its toe region and the quarters 14 in the heel region contain a stiffening material. This material imparts a measure of rigidity to the vamp 12 and quarters 14 and enables them to retain their shape in the absence of the user's foot. The shaft 16 is considerably more flexible and exhibits an inclination to fold, primarily in the region where it merges into the vamp 12 and quarters 14. Of course, a folded shaft 16 appears unsightly in a display and furthermore establishes creases at the fold. Moreover, even if the shaft 16 remains upright, it usually does not present a uniform exterior surface, but instead, one marked by a depression or two, and this also detracts from the appearance of the display. The shaft 16 of a boot B that has seen use should remain upright for the further reason of allowing air to circulate through the interior of the vamp and thereby evaporate moisture. The shape retainer A occupies the entirety of the shaft 16 and further extends through the quarters 14 to the heel seat 6. It not only maintains the shaft 16 upright, but further gives the shaft 16 a uniform exterior appearance devoid of depressions or creases and prevents creases from developing in it.

Figure 2:
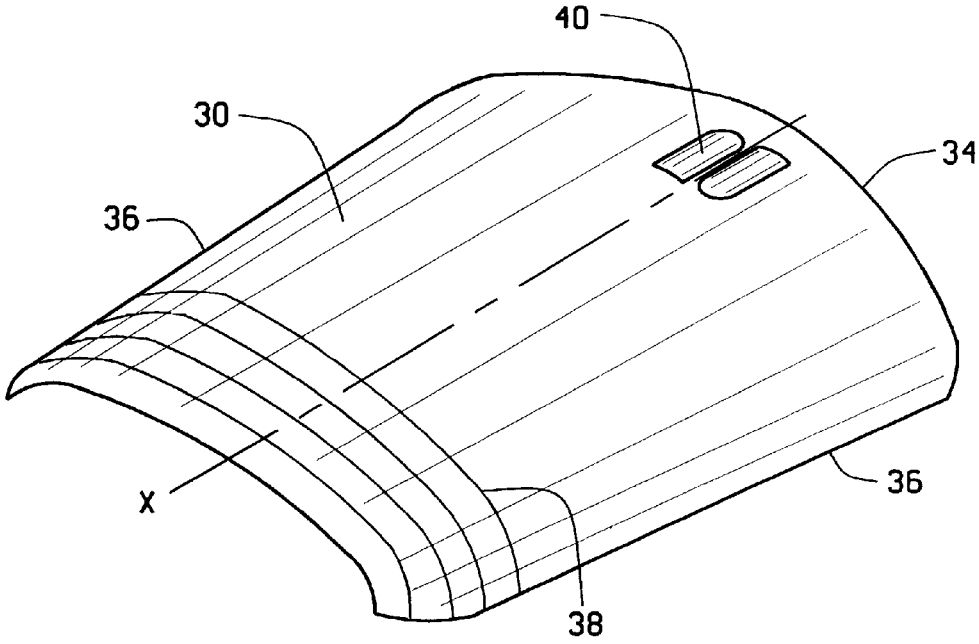
FIG. 2 is a perspective view of the polymer sheet that forms the shape retainer, when the sheet is open, yet slightly bowed.

The shape retainer A basically comprises a sheet 30 of polymer resin that is flexible, but not to the extent that it can be folded and creased or take on a permanent set other than a slight bow. When flexed and released, it should revert to generally its original shape. Even so, when unrestrained, the sheet 30 may possess a slight bow that facilitates rolling it into a coil or tube (FIG. 2). It should be translucent or opaque. Suitable polymers include polycarbonate or polyvinyl chloride having a thickness ranging between 0.015 to 0.020 inches and preferably 0.015 inches.

Figure 3:
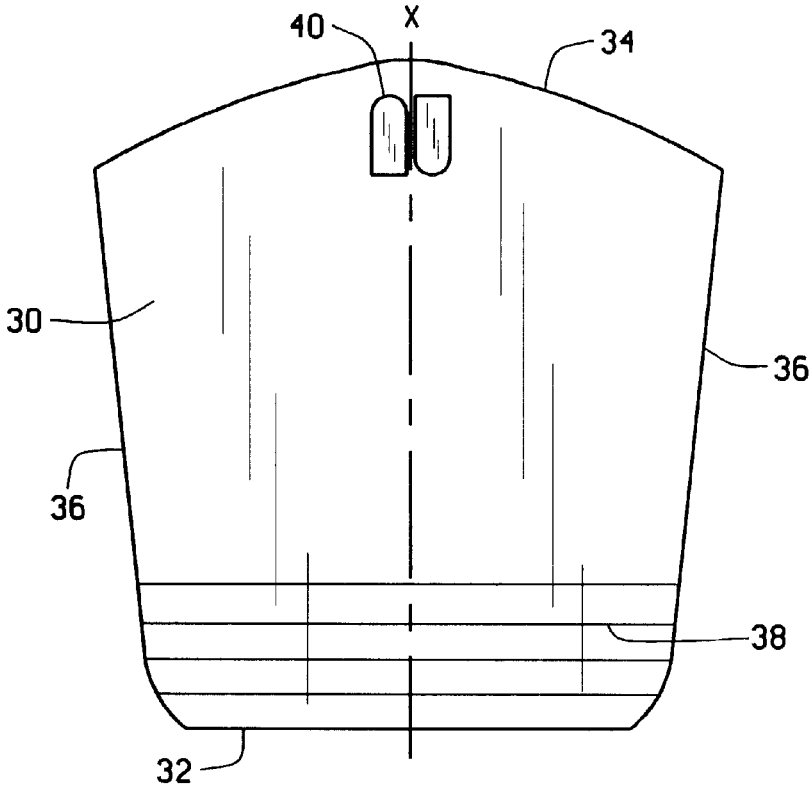
FIG. 3 is a plan view of the polymer sheet.

The sheet 30 when fully open (FIG. 3) has a straight lower edge 32 and an arcuate upper edge 34 which curves away from the bottom edge 32. It also has side edges 36 connecting the lower and upper edges 30 and 32. For the most part, the side edges 36 are straight, but near their lower ends they curve inwardly toward and intersect the straight lower edge 32. The two side edges 36 are equal in length and converge slightly toward the lower margin 32.

The sheet 30 is symmetrical about a centerline X (FIGS. 2 & 3) which bisects the lower edge 32 and the upper edge 36. Its side edges 36 converge toward the lower edge 32, lying at an angle of between 3° and 7° with respect to the centerline X and preferably at an angle of about 5°.

The width of the sheet 30 at the upper ends of the side edges 36, that is the distance between the side edges 36 where they intersect the upper edge 34, should be between 5% and 10% greater than the circumference of the shaft 16 on the boot B at the upper margin 18 on the shaft 16. The width of the sheet 30 immediately above the inwardly curved regions of the side edges 36, that is the distance between the lower levels of the straight portions of the side edges 36, should be between 5% and 10% greater than the circumference of the shaft 16 where the vamp 12 and quarters 16 merge into the shaft B. The arcuate upper margin 34 at its intersection with the centerline X rises between 1½ and 3 inches above the upper ends of the side margins 36 and preferably about 2 inches. The height of the sheet 30 at its side margins 36 is about equal to the distance between the heel seat 6 at the bottom of the two quarters 14 and the upper margin 18 at the upper end of the shaft 16.

Typically, the sheet 30 is about 13.6" wide at the upper ends of its side edges 36 and is about 11.6 inches wide where the side edges 36 begin to curve inwardly. The lower edge 32 between the curved corners, that is the straight portion of the lower edge 32, is about 7.8 inches wide. The height along the center line X is about 15.25 inches, but can range between 12.25 and 16.25 inches.

In its lower region the sheet 30 may have graduations 38 (FIGS. 2 & 3) at equal intervals, each parallel to the lower edge 32, to provide guidance in reducing the height of the sheet 30 so as to better accommodate shorter boots B. Along is its exposed upper region, indicia such as an advertising message or trademark 40, may be applied to the sheet 30. The region between the graduations 38 and the trademark 40 may contain instructions for using the shape-retainer A or other information.

Figure 4:
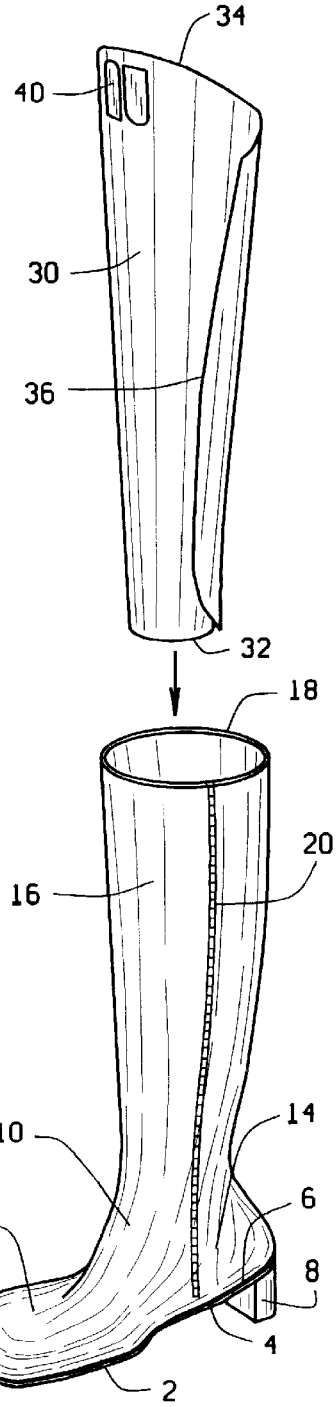
FIG. 4 is a perspective view of the boot with the rolled polymer sheet aligned with the boot shaft for insertion into the shaft where the sheet forms the shape retainer.

To install the shape retainer A in the boot B, the slightly bowed sheet 30 is converted into a tubular configuration having a width less than the smallest interior dimension of the shaft 16 (FIG. 4). To this end, following the curvature of the slightly bowed sheet 30, one of its side edges 36 is brought over and against one face of the sheet 30 generally in the region of its centerline X, giving the portion leading up to that side edge 36 a much more pronounced curvature. Then, the remaining portion of the sheet 30, that is the portion leading up to the other side edge 36, is wrapped around the previously curved portion. The other side edge 36 lies along the other face of the sheet 30. This converts the sheet 30 into a tubular configuration having a diameter less than the minimum width of the shaft 16. Of course, the rolled sheet 30, under the bias imparted by its own resiliency, seeks to expand and open, so one must grasp it tightly to prevent expansion.

Figure 5:
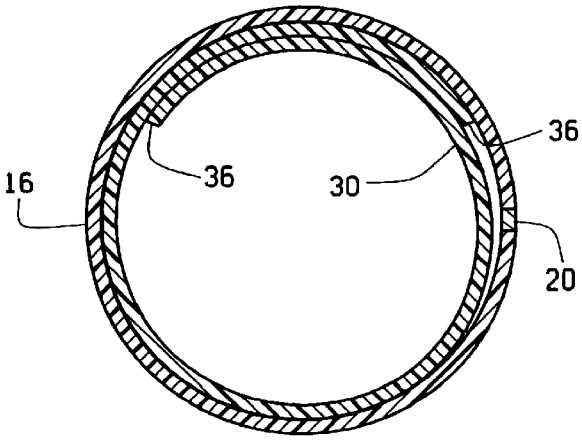
FIG. 5 is a sectional view taken along line 5—5 of FIG. 1.

The rolled sheet 30, while tightly gripped, is then inserted into the shaft 16 of the boot B at the upper margin 18 of the shaft 16 with the lower edge 32 of the sheet 30 leading (FIG. 4). Indeed, while maintained in its contracted tubular configuration the rolled sheet 30, is lowered through the shaft 16 and between the two quarters 14 until its lower edge 32 bottoms out against the heel seat 6. The rolled sheet 30 is rotated until the centerline X lies at the front of the shaft 16, whereupon the grip on the rolled sheet 30 is released. The rolled sheet 30 opens under the natural resiliency of the polymer and the sheet 30 expands against the interior surfaces of the shaft 16, (FIG. 5), thus forming the shape retainer A. It gives the exterior surface of the shaft 16 a smooth appearance unblemished by depressions or creases. Just as significantly, the shaft 16 remains upright over the vamp 12 and the two quarters 14. The arcuate upper edge 34 of the sheet 30 rises above the upper margin 18 of the shaft 16, leaving the trademark 40 exposed below that upper edge 34 and above the upper margin 18 of the shaft 16. At this time a final adjustment in the form of a slight rotation of the shape-retainer A may be made to insure that the trademark 40 is presented forwardly and centered with respect to the vamp 12.

To prolong the resiliency of the polymer of the sheet 30, the sheet may be rolled in opposite directions upon successive uses.

What is claimed is:

1. In combination with a boot having a sole that includes a heel seat and further having an upper that is attached to the sole and includes a vamp over the front of the sole and quarters at the heel seat as well as a shaft extending upwardly from the vamp and quarters and terminating at an upper margin, a shape retainer located in the shaft to maintain the shaft upright over the vamp and quarters, said shape retainer comprising: a sheet of flexible polymer having side edges and portions leading to the side edges, the sheet being in a curved and tubular configuration in which the portions leading to the side edges overlap and the side edges lie along opposite surfaces of the sheet, but with the overlapping portions otherwise being detached, the sheet seeking to expand by reason of the natural resiliency of the polymer, the curved sheet of polymer being within the shaft of the boot and bearing against the inside surface of the shaft under the natural resiliency of the polymer to maintain the shaft upright with a generally smooth appearance.

2. The combination according to claim 1 wherein the curved sheet extends into the quarters of the upper.

3. The combination according to claim 2 wherein the curved sheet extends down to substantially the heel seat of the sole.

4. The combination according to claim 2 wherein the curved sheet projects above the upper margin of the shaft.

5. The combination according to claim 2 wherein the sheet has an arcuate upper edge that extends between the side edges; and wherein at least a portion of the arcuate upper edge is above the upper margin of the shaft, so that a portion of the sheet is exposed above the upper margin of the shaft.

6. The combination according to claim 5 wherein the exposed portion of the sheet that is above the upper margin of the shaft bears indicia.

7. The combination according to claim 2 wherein the sheet has a lower edge that extends between the two side edges, and the lower edge lies along the heel seat.

8. The combination according to claim 7 wherein the sheet has markings that extend generally parallel to its lower edge at successive intervals to facilitate cutting the sheet to better accommodate a boot with a shorter shaft.

9. In combination with a boot having a sole that includes a heel seat and further having an upper that is attached to the sole and includes a vamp over the front of the sole and quarters at the heel seat as well as a shaft extending upwardly from the vamp and quarters and terminating at an upper margin, a shape retainer located in the shaft and comprising: a sheet of polymer material having two side edges, a bottom edge extending between the lower ends of the side edges and an upper edge extending between the upper ends of the side edges, the polymer material being flexible and resilient and when unrestrained seeking an open configuration in which the side edges are apart and away from the surfaces of the sheet, the sheet being rolled into a tubular configuration in which its two side edges lie along opposite surfaces of the sheet and the portions leading to the side edges overlap, but otherwise are detached, the rolled sheet being in the shaft of the boot with the bottom edge located between the quarters, the sheet under the bias of its own resiliency being expanded against the inside of the shaft, whereby the shaft is supported and remains upright above the quarters and vamp.

10. The combination according to claim 9 wherein the lower edge is along the heel seat of the boot.

11. The combination according to claim 9 wherein the side edges converge toward the lower edge.

12. The combination according to claim 9 wherein the upper edge of the sheet is arcuate and at least a portion of it lies above the upper margin of the shaft so that a portion of the sheet is exposed above the upper margin.

13. The combination according to claim 12 wherein the portion of the sheet that is exposed bears indicia.

14. A method of stabilizing a shaft that extends upwardly from the vamp and quarters of a boot, said method comprising: rolling an open sheet of flexible and resilient polymer material having side edges into a generally tubular configuration in which the portions leading to the side edges overlap, but are otherwise detached, with the sheet seeking to expand under the bias of its own resiliency; restraining the sheet in a tubular configuration small enough to fit into the shaft of the boot; while the sheet is so restrained, inserting it into the shaft of the boot; and releasing the sheet when it is in the shaft of the boot so that it expands against the inside of the shaft and retains the shaft upright.

15. The method of claim 14 wherein the sheet, when restrained in its tubular configuration, is inserted deeply enough into the shaft to lie, at its lower end, between the quarters.

16. The method according to claim 14 wherein the boot also has a sole including a heel seat over which the quarters are located; wherein the sheet has a lower edge; and wherein the sheet, when restrained in its tubular configuration, is inserted deeply enough into the shaft to enable the lower edge to lie along the heel seat.

17. The method according to claim 14 wherein the sheet has side edges, and when the sheet expands in the shaft, the side edges lie along opposite surfaces of the sheet.

18. The method according to claim 14 wherein the sheet is long enough to project out of the shaft of the boot when its lower end is between the quarters, of the boot.

* * * * *